US010252542B2

(12) United States Patent
Ohnishi

(10) Patent No.: US 10,252,542 B2
(45) Date of Patent: Apr. 9, 2019

(54) PRINTING SYSTEM

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/869,060

(22) Filed: Jan. 12, 2018

(65) Prior Publication Data

US 2018/0134045 A1 May 17, 2018

Related U.S. Application Data

(63) Continuation of application No. 14/280,674, filed on May 19, 2014, now abandoned.

(30) Foreign Application Priority Data

May 24, 2013 (JP) ..... 2013-110250

(51) Int. Cl.

| | |
|---|---|
| ***B41J 29/38*** | (2006.01) |
| ***B41J 2/21*** | (2006.01) |
| ***B41J 3/407*** | (2006.01) |
| *B41J 3/60* | (2006.01) |

(52) U.S. Cl.

CPC ..... *B41J 2/2103* (2013.01); *B41J 2/211* (2013.01); *B41J 3/4078* (2013.01); *B41J 3/60* (2013.01)

(58) Field of Classification Search

USPC ..... 347/14, 100, 106; 346/3

See application file for complete search history.

(56) References Cited

U.S. PATENT DOCUMENTS 5,204,736 A * 4/1993 Abe ..... H04N 1/46 346/3

6,151,040 A * 11/2000 Takada ..... B41J 2/01 347/106

7,942,488 B2 * 5/2011 Lang ..... B41J 2/17593 347/100

* cited by examiner

*Primary Examiner* — Lam S Nguyen

(74) *Attorney, Agent, or Firm* — JCIPRNET

(57) ABSTRACT

A printing system is provided. The printing system includes a medium of fabric; and a printing apparatus for performing printing of a design represented by a target color which is preset on the medium by an inkjet method. The printing apparatus includes an inkjet head for discharging an ink droplet of a target color ink which is an ink that is adjusted to present the target color on the medium. The design is formed by a plurality of patterns. Each of the plurality of patterns is drawn with the target color ink of only one color used in the inkjet head, and the inkjet head discharges the ink droplet to the plurality of patterns at a constant concentration which is preset for each of a plurality of target colors. The medium allows the ink not absorbed by the medium to reach a back surface of the medium.

13 Claims, 3 Drawing Sheets

PRINTING SYSTEM

CROSS-REFERENCE TO RELATED APPLICATION

This application is a continuation application of and claims the priority benefit of U.S. patent application Ser. No. 14/280,674, filed on May 19, 2014, now pending, which claims the priority benefit of Japan application serial no. 2013-110250, filed on May 24, 2013. The entirety of each of the above-mentioned patent applications is hereby incorporated by reference herein and made a part of this specification.

BACKGROUND

Technical Field

The present invention relates to a printing system, a printing apparatus and a printing method.

Description of the Background Art

A silk screen method or the like is widely used in the past as a method of performing textile printing on fabric. In textile printing by a silk screen method or the like, a plate in which a hole through which dye passes is formed in an area to be dyed in fabric is prepared in advance, and dyeing is performed using the plate.

In addition, an inkjet printer for performing printing by an inkjet method is used widely in the past, which is illustrated in http://www.mimaki.co.jp (Non-Patent Document 1). Furthermore, in recent years, it is considered to use an inkjet printer for various applications. It is also considered to perform textile printing on fabric by performing printing on a medium of fabric through the usage of ink for textile printing, for example.

When textile printing on fabric is performed by an inkjet printer, it is thought that dyeing of various designs can be performed efficiently because there is no necessity to prepare a plate in advance. However, through extensive research, the inventor of the present application found that it might be difficult to achieve, by merely using an inkjet printer having a traditional configuration, the equivalent quality to that of the case of dyeing in the conventional manner through a silk screen method and the like. Further, through extensive research, the inventor of the present application also found that the cause of such a problem is related to the principle that color printing is performed in an inkjet printer.

More specifically, for example, in an inkjet printer, color printing is usually performed by using respective colors of inks: Y, M, C and K. Therefore, when color printing is performed by an inkjet printer, the amount of ink to adhere to each position of a medium would be different depending on color or density to be represented. As a result, when printing is performed on a medium of fabric by an inkjet method, ink penetrates the fabric from a print surface to the shallow position in some areas, and ink penetrates even to the back side of the print surface in other areas, depending on color or density to be printed. In this case, in the back surface of the medium, in some areas where the print surface is pale in color, the original color of the fabric (e.g. white) is presented, and in other areas where the print surface is deep in color, the color of the print surface reaches to the back surface thereof.

As a result, for example, an impression is made that the printing is mottled when the back surface of the medium is seen after printing. In addition, since the amount of ink changes depending on color and density as described above, only one surface (printing surface) of the fabric can be dyed sufficiently.

Further, when color printing is performed by Y, M, C, K inks, if errors or variations occur in the discharge amount from the inkjet heads for each color, color blurring would occur. Furthermore, even if correction is performed on variations due to individual differences of the inkjet heads, it is difficult to avoid color blurring caused by malfunction or an error during the operation.

In addition, a medium of fabric may be washed after printing. When the medium is washed, some fibers (yarn) may move in the fabric. As a result, in an area where the amount of adhering ink is small, fibers where ink does not adhere may move, and the original color (white) of the fabric may appear on the front surface. Therefore, when printing is performed on a medium of fabric by an inkjet method, if an inkjet printer having a traditional configuration is used, wash fastness may become insufficient.

In order to sufficiently penetrate ink to the back surface of the fabric, for example, the overall amount of the ink to be discharged to the medium might be increased, so that the sufficient amount of ink adheres to an area which is pale in color. However, in order to perform color printing by using Y, M, C, K inks, typically, it is necessary to discharge ink droplets of different color inks to neighboring or overlapping positions. In this case, when the amount of ink to be discharged is increased, it takes a long time to be dried on the medium, and bleeding between inks of different colors is likely to occur. As a result, proper printing becomes difficult. Therefore, when printing is performed on a medium of fabric using Y, M, C, K inks, it is not easy to increase the amount of ink. Thus, an object of the present invention is to provide a printing apparatus and a printing method capable of solving the problems.

SUMMARY

The present invention has the following configuration to solve the problems descried above.

A printing system is provided. The printing system includes a medium of fabric; and a printing apparatus for performing printing of a design represented by a target color which is preset on the medium by an inkjet method. The printing apparatus includes an inkjet head for discharging an ink droplet of a target color ink which is an ink that is adjusted to present the target color on the medium. The design is formed by a plurality of patterns. Each of the plurality of patterns is drawn with the target color ink of only one color used in the inkjet head, and the inkjet head discharges the ink droplet to the plurality of patterns at a constant concentration which is preset for each of a plurality of target colors. The medium allows the ink not absorbed by the medium to reach a back surface of the medium.

Configuration 1: A printing apparatus for performing printing of a design represented by a preset target color on a medium of fabric by an inkjet method includes an inkjet head for discharging an ink droplet of a target color ink which is an ink that is adjusted to present the target color on the medium.

With this configuration, for example, the target color can be represented directly and appropriately by the ink discharged from one inkjet head. Therefore, for the ink after landed on the medium, it is possible to appropriately prevent bleeding between colors. As a result, for example, it is also possible to increase the amount of the ink to be discharged to the medium, as needed.

Therefore, with this configuration, it is possible for a sufficient amount of ink to adhere to each position on the medium, for example. In addition, this also allows for appropriate textile printing on the media of fabric by an inkjet method. Further, unlike the case where color printing is performed using Y, M, C, K inks, since the target color ink which corresponds to the desired target color is used from the beginning, even when variations or errors occur in the discharge amount from the inkjet heads, color blurring does not occur.

In addition, with this configuration, it is possible to appropriately prevent the impression that the printing is mottled even when the back surface of the medium is seen after printing since there is no need to change the amount of ink to adhere to the medium depending on a color or density to be represented, for example. Further, the ink may be allowed to reach the back side of the print surface, as needed. Therefore, with this configuration, it is possible to sufficiently dye the back side of the print surface as well, for example. Besides, it is possible to appropriately improve the wash fastness because a sufficient amount of ink can adhere to each position on the medium.

Note that "target color" may refer to color that is presented after processing, such as color development, which is performed after printing in order to complete textile printing, for example. "Target color ink" may refer to ink for providing desired target color after such processing. In addition, "design represented by target color" refers to a design such as a picture or a character containing a portion on which printing is performed by target color ink.

Configuration 2: The printing apparatus performs printing of a design represented by a plurality of the target colors that are different from each other on the medium, and includes a plurality of the inkjet heads corresponding to the plurality of target colors, wherein each of the inkjet heads discharges an ink droplet of each of target color inks which is adjusted to present its corresponding target color on the medium. With this configuration, for example, by providing dedicated inkjet heads for each of a plurality of target colors, a design represented by a plurality of target color can be printed efficiently and appropriately. Further, it is thus possible to more appropriately perform multicolored textile printing by an inkjet method, for example.

Configuration 3: an ink droplet of one of the target color inks is discharged to the medium by one of the inkjet heads, and an ink droplet of another of the target color inks is discharged to the medium by another of the inkjet heads subsequently, the another inkjet head discharges an ink droplet of another target color ink to the medium after the one target color ink landed on the medium is dried. "One target color ink" refers to ink that is adjusted to present one target color on the medium, for example. In addition, "another target color ink" refers to ink that is adjusted to present another target color that is different from the one target color on the medium, for example.

In this configuration, after a layer of one target color ink is dried sufficiently, a layer of another target color ink is formed. Therefore, with this configuration, for example, even when a plurality of kinds of target color inks are used, it is possible to appropriately prevent color bleeding between the inks. In addition, thus, it is possible to more appropriately perform multicolored textile printing by an inkjet method.

Note that "after one target color ink landed on the medium is dried" may represent that, for example, the one target color ink is sufficiently dried to the extent that the purpose for appropriately preventing color bleeding between inks is met. Further, for example, the operation of printing on the medium may be the operation of printing on a partial area of the medium. In this case, for example, after sequentially forming layers of one and another target color inks on the partial area, the printing apparatus further sequentially forms layers of one and another target color inks on another area on the medium.

Configuration 4: The printing apparatus further includes an ink bottle which stores the target color ink, and supplies the target color ink to the inkjet head. With this configuration, for example, the target color ink may be stored appropriately, and supplied to the inkjet head.

Further, even when the color of the target color ink is adjusted or changed, the ink can be refilled easily and appropriately.

Configuration 5: The inkjet head discharges an ink droplet at a preset constant concentration to a print area where printing is to be performed on the medium with the target color ink. With this configuration, for example, the amount of penetration of ink to each position of the medium can be uniformized appropriately. Further, it is possible to more appropriately prevent the impression that the printing is mottled when the back surface of the medium is seen.

Note that "the inkjet head discharges an ink droplet at a preset constant concentration" means that printing is performed at a constant print density, or at a constant printing rate, for example. For example, a constant print density may be set to 100% in advance in an inkjet printer. In addition, for example, depending on the amount of ink to adhere to the medium, a constant print density other than 100% may be set. A higher print density, e.g., 200%, may be set.

Configuration 6: With respect to a print area where printing is to be performed on the medium with the target color ink, after discharging an ink droplet to one surface of the medium, the inkjet head further discharges an ink droplet to another surface of the medium. With this configuration, for example, ink adheres to the medium from both surfaces thereof, thus, textile printing can be reliably performed on both surfaces of the medium. In addition, as a result, it is possible to appropriately render a design with high accuracy on the front and back surfaces of the medium.

Configuration 7: A medium holding member for holding the medium with the medium being stretched is used, the inkjet head discharges an ink droplet to the medium that is held by the medium holding member with the one surface of the medium facing the inkjet head, so as to discharge an ink droplet to the one surface of the medium, and the inkjet head discharges an ink droplet to the medium which is reversed while the medium is held by the medium holding member, so as to discharge an ink droplet to another surface of the medium. In the printing apparatus, the medium holding member is disposed at a position where the relative position to the inkjet head is known, for example.

With this configuration, use of the medium holding member facilitates alignment of the medium with respect to the inkjet head, for example. In addition, even after the medium is reversed, it is possible to perform printing to an appropriate position with high accuracy. Therefore, with this configuration, it is possible to more appropriately perform printing on each of the front and back surfaces of the medium. In addition, it is possible to perform textile printing more reliably on both surfaces of the medium.

Configuration 8: A printing method for performing printing of a design represented by a preset target color on a medium of fabric by an inkjet method, wherein an inkjet head for discharging an ink droplet of a target color ink which is an ink that is adjusted to present the target color on the medium is used to perform printing. With this configuration, for example, it is possible to obtain the same effect as in the configuration 1.

Configuration 9: A printing apparatus for performing printing on a medium by an inkjet method includes an inkjet head for discharging an ink droplet, wherein a medium holding member for holding the medium with the medium being stretched is used to hold the medium, the inkjet head discharges an ink droplet to the medium that is held by the medium holding member with the one surface of the medium facing the inkjet head, so as to discharge an ink droplet to the one surface of the medium in a print area where printing is to be performed on the medium, and the inkjet head discharges an ink droplet to the medium which is reversed while the medium is held by the medium holding member, so as to discharge an ink droplet to another surface of the medium in the print area.

With this configuration, use of the medium holding member facilitates alignment of the medium with respect to the inkjet head, for example. In addition, even after the medium is reversed, it is possible to perform printing to an appropriate position with high accuracy. Therefore, with this configuration, it is possible to more appropriately perform printing on each of the front and back surfaces of the medium.

Further, with this configuration, it is possible to align the position of the inkjet head to each of the front and back surfaces of the medium with high accuracy, resulting in high accuracy printing by superimposing each picture printed on the front and back surfaces on each other, for example. As a result, when a medium of fabric or the like is used, even when inks similar or identical to those used in a traditional inkjet printer such as Y, M, C, K inks are used without using the target color ink described above, the medium holding member described above is used to superimpose the pictures on the front and back surfaces of the medium and then printing is performed, thus, it is possible to appropriately improve the wash fastness. In addition, the problem that there is a non-colored portion on the back surface can also be alleviated. Therefore, with this configuration, for example, it is possible to solve a problem occurring when printing is performed on a medium of fabric or the like in a traditional manner. In addition, for example, it is possible to appropriately perform printing on a medium of fabric or the like.

Also, in addition to performing printing on a medium of fabric or the like, for example, when it is necessary to align the positions of images or pictures on the front and back surfaces or to align the relative position of the images on the front and back surfaces with respect to a predetermined position with high accuracy, using the medium holding member described above allows for appropriate printing with high accuracy. More specifically, for example, the medium holding member described above may be preferably used when printing is performed on both surfaces of a transparent medium, such as a plastic plate or film.

Configuration 10: A printing method for performing printing on a medium by an inkjet method, wherein an inkjet head for discharging an ink droplet is used, a medium holding member for holding the medium with the medium being stretched is used to hold the medium, the inkjet head discharges an ink droplet to the medium that is held by the medium holding member with the one surface of the medium facing the inkjet head, so as to discharge an ink droplet to the one surface of the medium in a print area where printing is to be performed on the medium, and the inkjet head discharges an ink droplet to the medium which is reversed while the medium is held by the medium holding member, so as to discharge an ink droplet to another surface of the medium in the print area. With this configuration, for example, it is possible to obtain the same effect as in the configuration 9.

According to the present invention, textile printing by an inkjet method can be appropriately performed on a medium of fabric, for example.

BRIEF DESCRIPTION OF THE DRAWINGS

FIGS. 1A and 1B are diagrams showing an example of a printing apparatus according to an embodiment of the present invention, wherein FIG. 1A shows an example of the configuration of the main part of the printing apparatus and FIG. 1B shows an example of a design drawn on a medium by the printing apparatus.

FIGS. 2A and 2B are diagrams illustrating in more detail the discharge of an ink droplet to the medium, wherein FIG. 2A shows an example of the medium being held when ink droplets are discharged by the inkjet heads and FIG. 2B shows an example of the state of the medium after printing on both surfaces thereof.

DETAILED DESCRIPTION OF THE EMBODIMENTS

Figure 1A:
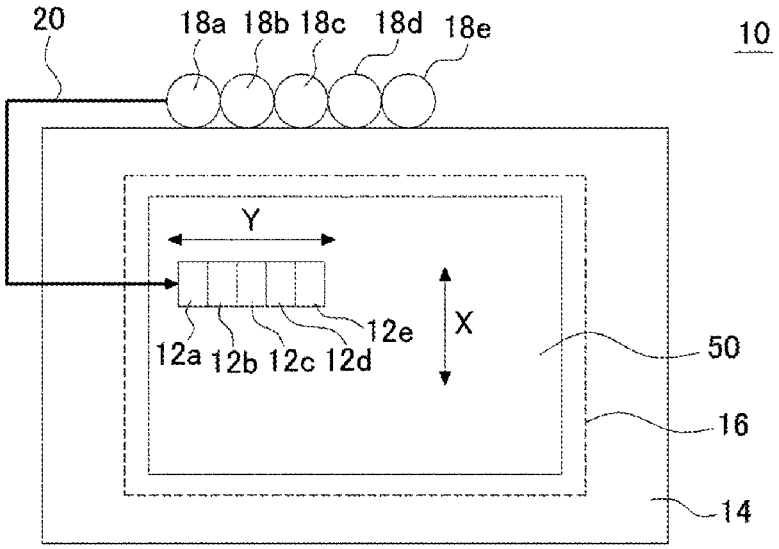
Figure 1B:
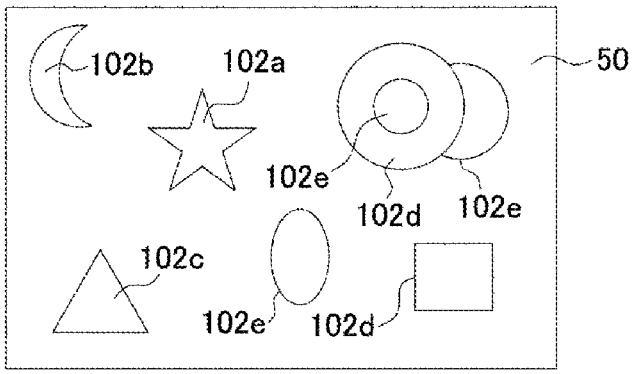

An embodiment according to the present invention will now be described with reference to the accompanying drawings. FIGS. 1A and 1B are diagrams showing an example of a printing apparatus 10 according to an embodiment of the present invention. In this embodiment, the printing apparatus 10 is an inkjet printer using textile printing ink, and performs printing of a design represented by a plurality of target colors which are different from each other on a medium 50 of fabric by an inkjet method.

Note that, in the following description, "printing" refers to drawing a preset design by discharging ink droplets to the medium 50. In order to perform textile printing on the media 50 of fabric, for example, after printing, further processing such as color development is performed in order to complete textile printing. A plurality of target colors are preset colors represented by textile printing, and are determined in accordance with desired color saturation and brightness or density, for example. In this embodiment, for example, when color saturation is the same, but brightness to be represented is different, it is said that target colors are different. Further, "color saturation and brightness represented by a target color" means, for example, brightness and color saturation when printing is performed at a preset print density or at a preset printing rate. "Print density" refers to, for example, the amount of ink discharged per unit area.

In addition, Fabric refers to those obtained by processing a large number of fibers into a thin and wide plate form, for example. For example, the fabric may be a textile. Further, it may be knitted fabric, lace, felt, or nonwoven fabric. Further, in the printing apparatus 10 of this example, the medium 50 is held by a medium holding member 16 which is an attachment member with respect to the printing apparatus 10. The medium holding member 16 holds the medium 50 of fabric with its being stretched.

FIG. 1A shows an example of a configuration of the main part of the printing apparatus 10. In this embodiment, the printing apparatus 10 includes a plurality of inkjet heads 12*a* to 12*e*, a table 14, a plurality of ink bottles 18*a* to 18*e* and an ink path 20. The plurality of inkjet heads 12*a* to 12*e* are print heads for discharging ink droplets of textile printing ink by an inkjet method. Further, in this embodiment, the plurality of inkjet heads 12*a* to 12*e* discharge ink droplets of target color inks corresponding to target colors different from each other, respectively.

In this embodiment, "target color ink" refers to an ink that is adjusted to present the target color that is set in advance on the medium 50. Moreover, "target color inks corresponding to target colors different from each other" refer to, for example, target color inks that are adjusted to present target colors different from each other on the medium 50. "Target color" may refer to color that is presented after processing, such as color development, which is performed after printing in order to complete textile printing, for example. "Target color ink" may refer to ink for providing desired target color after such processing. Further, as described above, in this embodiment, target color ink is textile printing ink. "Textile printing ink" refers to dye ink for textile printing, for example. In this embodiment, textile printing ink is, for example, the ink similar or identical to textile printing ink that is known other than color may be used.

The table 14 holds the medium 50 with the medium 50 facing the inkjet heads 12*a* to 12*e*. In this embodiment, the medium holding member 16 is placed on the upper surface of the table 14, so that the medium 50 held by the medium holding member 16 faces the inkjet heads 12*a* to 12*e*.

A plurality of ink bottles 18*a* to 18*e* are refillable ink reservoirs. Each of the plurality of ink bottles 18*a* to 18*e* is provided correspondingly to each of the plurality of inkjet heads 12*a* to 12*e* and stores each target color ink corresponding to each inkjet head. Further, each of the plurality of ink bottles 18*a* to 18*e* supplies target color ink corresponding to each inkjet head through the ink path 20. The ink path 20 connects the plurality of ink bottles 18*a* to 18*e* with the plurality of inkjet heads 12*a* to 12*e*.

Further, in addition to the configuration described above, the printing apparatus 10 may further have a configuration similar or identical to that of a known inkjet printer using textile printing ink as various components required for the operation of printing, although a detailed description thereof will be omitted. For example, the printing apparatus 10 further includes a driving unit and a control unit for causing the inkjet heads 12*a* to 12*e* to perform main scanning operation and sub scanning operation. The main scanning operation is an operation in which the inkjet heads 12*a* to 12*e* discharge ink droplets while moving in a preset main scanning direction, Y-direction, for example. Further, the sub scanning operation is an operation in which the inkjet heads 12*a* to 12*e* move relatively to the medium 50 in the sub scanning direction, X-direction, perpendicular to the main scanning direction, for example. In the sub scanning operation, for example, the inkjet heads 12*a* to 12*e* are moved while the medium 50 is being fixed. Alternatively, in the sub scanning operation, for example, the table 14 may be moved so as to move the medium 50 while the inkjet heads 12*a* to 12*e* are being fixed.

In this embodiment, the plurality of inkjet heads 12*a* to 12*e* may appropriately discharge ink droplets of a plurality of target color inks which are different from each other to each position of the medium 50. Thus, it is possible to appropriately draw a design represented by a plurality of target colors on the medium 50.

In this embodiment, as described above, the ink bottles 18*a* to 18*e* are used to supply ink to the inkjet heads 12*a* to 12*e*. Therefore, in this embodiment, even when the color of the target color ink is adjusted or changed, the ink can be refilled easily and appropriately. In addition, for example, the color of the target color ink may be adjusted and changed more easily and appropriately.

Subsequently, a design drawn by the printing apparatus 10 will be described in more detail. FIG. 1B shows an example of a design drawn on the medium 50 by the printing apparatus 10. In this embodiment, on the medium 50 of fabric, the printing apparatus 10 draws a design formed by a plurality of patterns 102*a* to 102*e*, for example. In this embodiment, each of the plurality of patterns 102*a* to 102*e* is a picture or a character respectively constituting a part of the design on the medium 50.

Further, each of the patterns 102*a* to 102*e* is drawn by either of the plurality of inkjet heads 12*a* to 12*e* with one target color ink used in the inkjet head. For example, the pattern 102*a* is drawn by the inkjet head 12*a* with the target color ink corresponding to the inkjet head 12*a*. Similarly, each of the patterns 102*b* to 102*e* is drawn by each of the plurality of inkjet heads 12*b* to 12*e* with each target color ink corresponding to each inkjet head.

With this configuration, for example, for each of the patterns 102*a* to 102*e*, a target color can be represented directly and appropriately by the ink to be discharged from one inkjet head. Therefore, for ink after landed on the medium 50, it is possible to appropriately prevent bleeding between colors. Further, as a result, for example, it is possible to increase the amount of ink discharged to the medium 50, as needed. Therefore, in this embodiment, a sufficient amount of ink may adhere to each position on the medium 50, for example. Thus, textile printing by an inkjet method can be appropriately performed on the medium 50 of fabric.

Further, with this configuration, since the target color ink which corresponds to the desired target color is used from the beginning, even when variations or errors occur in the discharge amount from the inkjet heads 12*a* to 12*e*, color blurring does not occur. Further, since a sufficient amount of ink may adhere to each position of the medium 50, the color change is reduced even if there is reversal of the yarn. In addition, for example, it is possible to appropriately improve the wash fastness of the medium 50 after textile printing is completed.

Furthermore, since a sufficient amount of ink may adhere to each position of the medium 50, when printing is performed by the printing apparatus 10 in this embodiment, it is possible to more appropriately prevent the impression that the printing is mottled, for example, even when the back surface of the medium 50 after printing is seen. Further, the ink may be allowed to reach the back side of the print surface, as needed. Therefore, in this embodiment, for example, even when printing is performed on only one surface of the medium 50, the back side of the print surface can also be stained well.

Further, when printing on the medium 50 of fabric is performed by an inkjet printer, pre-processing or the like to prevent ink bleeding may be performed. Further, in this case, the ink hardly penetrates into the medium 50, and when the amount of ink is small, the ink is harder to appropriately adhere to the medium 50. In contrast, in this embodiment, as described above, it is possible to appropriately increase the amount of ink discharged to the medium 50. Therefore, in this embodiment, for example, the ink can adhere to the medium 50 appropriately even when the pre-processing or the like to prevent ink bleeding is performed on the medium 50.

In addition, in this embodiment, for example, by providing dedicated inkjet heads 12*a* to 12*e* for each of a plurality of target colors, a design represented by a plurality kinds of target colors can be printed efficiently and appropriately. Further, it is thus possible to more appropriately perform multicolored textile printing by an inkjet method.

In this embodiment, each of the target color inks is color ink different from each of the Y, M, C, K color inks, for example, and is made by mixing yellow (Y), magenta (M), cyan (C) and black (K) inks from the Y, M, C, K inks in advance. More specifically, for example, the target color ink in predetermined color A is obtained by adjusting the mixing ratio $\alpha-\gamma$ such that $A=\alpha\cdot Y+\beta\cdot M+\gamma\cdot C+\delta\cdot K$, wherein $\alpha$ is the mixing ratio of yellow (Y), $\beta$ is the mixing ratio of magenta (M), $\gamma$ is the mixing ratio of cyan (C), and $\delta$ is the mixing ratio of black (K).

Further, depending on desired color representation, for example, each of the Y, M, C, K color inks may be directly used as an expression color ink. In this case, in the printing apparatus 10, when an expression color other than each color of Y, M, C, K is used, a color ink different from each of the color inks Y, M, C, K is used.

Further, in the configuration shown in FIGS. 1A and 1B, the printing apparatus 10 includes five inkjet heads 12*a* to 12*e*. However, when more than five target colors are used, the printing apparatus 10 may include more inkjet heads. Further, for example, by replacing ink to be stored in the ink bottles 18*a* to 18*e* during printing, it is also possible to use more target colors than the number of the inkjet heads. Further, by using a plurality of the printing apparatuses 10, target colors more than the number of the inkjet heads in one printing apparatus 10 may be used. In these cases, it is also possible to appropriately perform multicolored textile printing on the medium 50.

Figure 2A:
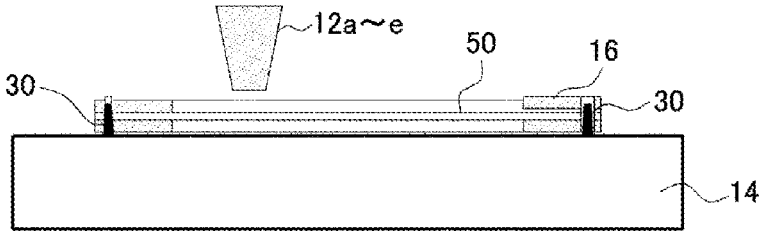
Figure 2B:
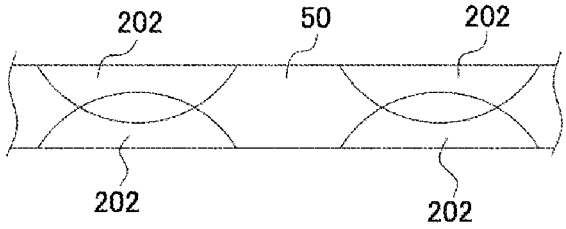

Next, the operation of printing on the medium 50 will be described in more detail. FIGS. 2A and 2B are diagrams illustrating in more detail the discharge of an ink droplet to the medium 50. FIG. 2A shows an example of the medium 50 being held when ink droplets are discharged by the inkjet heads 12*a* to 12*e*.

As described in connection with FIGS. 1A and 1B, in this embodiment, the medium 50 of fabric and the like is held by the medium holding member 16 placed on the table 14, so as not to be loose in the similar manner to a silk screen process to stretch the screen to hold a medium. The medium holding member 16 holds the medium 50 with the medium 50 being stretched so that the one surface of the medium 50 faces the inkjet heads 12*a* to 12*e*. Further, in this embodiment, a pin 30 for positioning the medium holding member 16 is provided on the table 14. Thus, the medium holding member 16 is placed on a known position which is previously set on the table 14. With this configuration, it is possible to align the medium 50 with respect to the inkjet heads 12*a* to 12*e* with high accuracy. In addition, it is possible to perform printing on the medium 50 with high accuracy.

Further, as shown in FIG. 2A, the medium holding member 16 holds the medium 50 in a state in which a space is provided between the medium 50 and the upper surface of the table 14. With this configuration, for example, ink which is not absorbed by the medium 50 among inks discharged toward the medium 50 from the inkjet heads 12*a* to 12*e* can be pulled out to the back surface of the medium 50. Thus, it is possible to appropriately prevent ink from spreading to the outside of an area where printing is to be performed even when a large amount of ink is discharged to the medium 50, for example. Therefore, in this embodiment, it is possible to appropriately discharge a sufficient amount of ink to the medium 50, for example.

Further, in this embodiment, the medium holding member 16 allows the front surface and back surface of the medium 50 to be reversed, and allows the other surface of the medium 50 to face the inkjet heads 12*a* to 12*e* when the medium 50 is placed on the table 14 with the medium 50 being reversed. Also, in this case, with alignment by the pin 30 or the like, the position of the medium 50 can be aligned with respect to the inkjet heads 12*a* to 12*e* with high accuracy.

Therefore, in this embodiment, for example, textile printing can be performed on both surfaces of the medium 50 reliably and appropriately. Thus, for example, it is possible to appropriately perform digitized printing by an inkjet method in the manufacture of products on which high textile printing quality is required on front and back surfaces, such as scarf, handkerchief, and higher quality design fabric.

FIG. 2B shows an example of the state of the medium 50 after printing on both surfaces thereof. When performing printing on both surfaces of the medium 50, in the printing apparatus 10 of this embodiment, first, the inkjet heads 12*a* to 12*e* discharge ink droplets to one surface of the medium 50, to perform printing on one surface of the medium 50. Then, while the medium 50 is being held by the medium holding member 16, the top and bottom of the medium holding member 16 are reversed to reverse the medium 50. Then, the inkjet heads 12*a* to 12*e* discharge ink droplets to the other surface of the medium 50 to perform printing on the other surface of the medium 50.

Further, when performing printing on both surfaces of the medium 50, the printing apparatus 10 of this example performs printing on the one and the other surfaces of the medium 50 to superimpose designs on both surfaces, for example. "Perform printing to superimpose designs on both surfaces" means that a reversible image is printed on front and back surfaces by printing on the other surface a reversed mirror image which superimposes on the image printed on the one surface. In this case, more specifically, to a print area in the medium 50 where printing is to be performed with the target color ink, after discharging ink droplets to one surface of the medium 50, each of the inkjet heads 12*a* to 12*e* further discharges ink droplets to the other surface of the medium 50.

In this case, in the medium 50 after being printed on both surfaces, on the print area, ink permeates from each of the one surface and the other surface of the medium 50, and, as shown in the figure, an ink-permeable portion 202 is formed on each of the one surface and the other surface of the medium 50. In this case, since printing is performed with the same target color ink from each of the front and back surfaces, bleeding between colors does not occur even when ink is placed on the medium 50 to the extent that the ink reaches the back surface of the medium 50, for example.

Further, in this embodiment, with respect to the print area, the inkjet heads 12*a* to 12*e* discharge ink droplets at a preset constant concentration. "Discharging ink droplets at a preset constant concentration" means that printing is performed at a constant print density, or at a constant a printing rate, for example. For example, a constant print density may be set to 100% in advance in the printing apparatus 10. In addition, for example, depending on the amount of ink to adhere to the medium, a constant print density may be set to a higher print density, e.g., 200%.

With this configuration, a constant amount of ink can reach the back surface of the medium 50, regardless of the concentration of the ink. Even when printing is performed on both surfaces of the medium 50, for example, as shown in the figure, the ink permeable portion 202 can appropriately uniformize the amount of penetration of the ink to each position of the medium 50. Thus, it is possible to perform uniform printing on the entire front and back surfaces of the medium 50. Further, for example, it is possible to appropriately prevent the impression that the printing is mottled when the back surface of the medium is seen.

Therefore, in this embodiment, for example, textile printing can be performed on both surfaces of the medium 50 reliably and appropriately. In addition, as a result, it is possible to appropriately render a design with high accuracy on the front and back surfaces of the medium 50.

Figure 3:
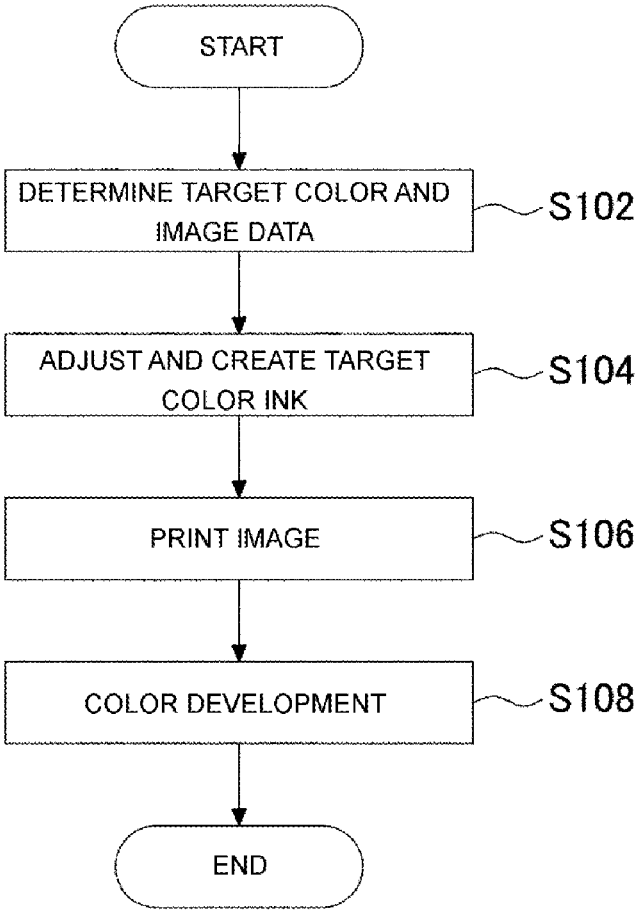
FIG. 3 is a flowchart showing an example of textile printing performed by using the printing apparatus in this example.

FIG. 3 is a flowchart showing an example of textile printing performed by using the printing apparatus 10 in this embodiment. FIG. 3 also shows the step of printing by using the printing apparatus 10, and an example of pre- and post-printing steps. Note that, in the process of textile printing, for example, various known processes in addition to those described below may be performed.

In the process of textile printing of this embodiment, first, a design to be expressed by textile printing on the medium 50 of fabric is determined in Step S102. Further, depending on the determined design, target color to be expressed by textile printing and image data representing the design are determined.

Note that "target color expressed by textile printing" refers to, for example, a color to be reproduced when the process of textile printing is completed. The target color is determined based on, for example, a color chart which is created in advance, and more preferably, an actual measurement data. Further, when multicolored textile printing is performed, a plurality of target colors is used depending on the required number of colors. In addition, as the image data representing the design, image data for each target color is prepared. For example, the image data for each target color is data obtained by color separation of a desired design, and, represents each target color portion in the design expressed by textile printing.

Next, according to the determined target color, the target color ink which is the ink required to reproduce the target color is adjusted and created in Step S104. When multicolored textile printing is performed, in this step, for each of a plurality of target colors to be used, target color inks are adjusted and created.

The adjustment of target color inks is carried out by adjusting the mixing ratio of each of color inks, that is, Y, M, C, K inks, for example. Further, in the adjustment, for example, each of the Y, M, C, K inks are blended, the measurement data value of the color reproduced by an ink is compared with the color chart, and, depending on the comparison result, the mixing ratio of each color ink is adjusted. For each of the Y, M, C, K color inks, the mixing ratio required to obtain the target color, that is, a required blending ratio is determined. After the adjustment is completed, by mixing each of the Y, M, C, K color inks at a required blending ratio, target color ink is created.

Then, after the target color ink is created, the printing apparatus 10 prints a design to be expressed by textile printing on the medium 50 in Step S106. In this step, for example, when performing multicolored textile printing, each created target color ink for each color is stored in each of the ink bottles 18*a* to 18*e* by color. Then, by supplying target color ink from each of the ink bottles 18*a* to 18*e*, each of the inkjet heads 12*a* to 12*e* is filled with the corresponding target color ink. By each of the inkjet heads 12*a* to 12*e*, the ink droplets of the filled target color ink are discharged to the medium 50 based on image data representing a design. Thus, by using the inkjet heads 12*a* to 12*e*, an image corresponding to the image data for each target color is printed.

Here, in this embodiment, when multicolored textile printing is performed, the printing with a plurality of target color inks is performed by a method in which after a layer of one target color ink is sufficiently dried, a layer of another target color ink is formed (layer method). More specifically, for example, when multicolored textile printing is performed with a plurality of target colors C1 to Cn, assuming that, among a plurality of inkjet heads 12*a* to 12*e*, heads H1 to Hn correspond to the target colors C1 to Cn, and C1 to Cn image data are the image data for each of the plurality of target colors C1 to Cn, first, an image corresponding to the C1 image data is printed at a preset constant print density, that is, at a preset constant printing rate, by the head H1 filled with the target color ink corresponding to the target color ink C1.

Then, after the printing of the image corresponding to the C1 image data is completed, and the ink is dried sufficiently, an image corresponding to the C2 image data is printed at a constant print density by the head H2 filled with the target color ink corresponding to the target color C2. In the same manner, sequentially, after the printing of the image corresponding to the Cn−1 image data is completed, and the ink is dried sufficiently, an image corresponding to the Cn image data is printed at a constant print density by the head Hn filled with the target color ink corresponding to the target color Cn.

When printing is performed in this way, for example, after a layer of one target color ink is dried sufficiently, a layer of the other target color ink is formed. Therefore, even when a plurality of target color inks different from each other is used, it is possible to appropriately prevent color bleeding between inks. In addition, thus, it is possible to more appropriately perform multicolored textile printing by an inkjet method, for example.

Note that, in this step, "after ink is dried" may represent that, for example, the ink is sufficiently dried to the extent that the purpose for appropriately preventing color bleeding between inks is met. In addition, in the layer method as described above, it is conceivable that, for example, instead of performing printing on the entirety of the medium 50, the medium 50 is divided into a plurality of areas, and printing is performed for each area. In this case, for example, after sequentially printing images corresponding to the C1 to Cn image data on a partial area in the medium 50, the printing apparatus 10 sequentially prints images corresponding to the C1 to Cn image data on the next partial area.

Further, following the step of the printing, color development is performed in Step S108, which is to be performed after printing in order to complete textile printing. For example, the processing performed in this step may be a process similar or identical to known color development which is performed in the process of textile printing. For example, in this step, by heating or steaming the medium 50 after printing, target color ink provides the target color. Further, after the target color is provided, the medium 50 is washed and dried. Thus, the process of textile printing on the medium 50 is completed.

As described above, in this embodiment, for example, it is possible to reduce color blurring and appropriately perform textile printing with target color by using target color ink corresponding to target color. Furthermore, by performing printing at a constant print density, a constant amount of ink is possible to reach the back surface regardless of the concentration of the ink or the like. Further, by performing printing in the layer method, for example, even if a large amount of ink is discharged to the medium 50, color bleeding between inks can be appropriately reduced. Further, for example, it is possible to put the sufficient amount of ink to reach the back surface. Further, for example, it is possible to perform printing on front and back surfaces. In addition, for example, it is possible to perform digitized printing by an inkjet method in the manufacture of products on which color development is required on front and back surfaces, such as scarf, handkerchief, and higher quality design fabric. Thus, in this embodiment, textile printing by an inkjet method can be appropriately performed on a medium of fabric, for example.

In addition to a case where target color ink is used, the medium holding member 16 described with reference to FIGS. 2A and 2B may also be preferably used. More specifically, for example, as described with reference to FIGS. 2A and 2B, use of the medium holding member 16 facilitates alignment of the medium 50 with respect to the inkjet head. In addition, even after the medium 50 is reversed, it is possible to perform printing to the appropriate position with high accuracy. Therefore, by using the medium holding member 16, it is possible to appropriately perform printing with high accuracy on each of the front and back surfaces of the medium 50. Further, as a result, for example, it is possible to readily perform printing pictures on the front and back surfaces of the medium 50 by superimposing them on each other with high accuracy.

As a result, for example, when the medium 50 of fabric or the like is used, even when inks similar or identical to those used in a traditional inkjet printer such as Y, M, C, K inks are used without using the target color ink, the medium holding member 16 is used to superimpose the pictures on the front and back surfaces of the medium 50 and then printing is performed, thus, it is possible to appropriately improve the wash fastness. In addition, the problem that there is a white portion on the back surface can also be alleviated. Therefore, with this configuration, for example, it is possible to solve the problems occurred when printing is performed on the medium 50 of fabric or the like in a traditional manner. In addition, for example, it is possible to appropriately perform printing on the medium 50 of fabric or the like.

Also, in addition to performing printing on the medium 50 of fabric or the like, for example, when it is necessary to align the positions of images or pictures on the front and back surfaces or to align the relative position of the images on the front and back surfaces with respect to a predetermined position with high accuracy, using the medium holding member 16 allows for appropriate printing with high accuracy. More specifically, for example, the medium holding member 16 may be preferably used when printing is performed on both surfaces of a transparent medium, such as a plastic plate or film.

Although the present invention has been described based on the embodiment, the present invention is not limited to the embodiment described above. It will be understood readily by those skilled in the art that various changes and modifications may be made to the embodiment described above. That the embodiment added with such changes and modifications can be included in the technical scope of the present invention are apparent from the appended claims.

The present invention may be preferably applied to a printing apparatus.

What is claimed is:

1. A printing system, comprising:

a medium of fabric; and a printing apparatus for performing printing of a design represented by a target color which is preset on the medium by an inkjet method, wherein the printing apparatus comprising an inkjet head for discharging an ink droplet of a target color ink which is an ink that is adjusted to present the target color on the medium, the design is formed by a plurality of patterns, each of the plurality of patterns is drawn with the target color ink of only one color used in the inkjet head, and the inkjet head discharges the ink droplet to the plurality of patterns at a constant concentration which is preset for each of a plurality of target colors, a portion of the ink is absorbed by the medium and another portion of the ink is not absorbed by the medium, and the another portion of the ink not absorbed by the medium is allowed to reach the back surface of the medium.

2. The printing system according to claim 1, wherein each of the plurality of target colors is an expression color other than each color of Y, M, C, K.

3. The printing system according to claim 1, wherein the constant concentration is a print density higher than 100%.

4. The printing system according to claim 1, wherein the printing apparatus comprising a plurality of inkjet heads, an ink droplet of one of the target color inks is discharged to the medium by one of the inkjet heads, and an ink droplet of another of the target color inks is discharged to the medium by another of the inkjet heads subsequently, the another inkjet head discharges an ink droplet of the another target color ink to the medium after the one target color ink landed on the medium is dried.

5. The printing system according to claim 1, further comprising:

an ink bottle, which stores the target color ink and supplies the target color ink to the inkjet head.

6. The printing system according to claim 1, wherein with respect to a print area where printing is to be performed on the medium with the target color ink, after discharging an ink droplet to one surface of the medium, the inkjet head further discharges an ink droplet to another surface of the medium.

7. The printing system according to claim 6, wherein a medium holding member for holding the medium with the medium being stretched is used, the inkjet head discharges an ink droplet to the medium that is held by the medium holding member with the one surface of the medium facing the inkjet head, so as to discharge an ink droplet to the one surface of the medium, and the inkjet head discharges an ink droplet to the medium which is reversed while the medium is held by the medium holding member, so as to discharge an ink droplet to another surface of the medium.

8. The printing system according to claim 4, further comprising:

an ink bottle, which stores the target color ink and supplies the target color ink to the inkjet head.

9. The printing system according to claim 4, wherein with respect to a print area where printing is to be performed on the medium with the target color ink, after discharging an ink droplet to one surface of the medium, the inkjet head further discharges an ink droplet to another surface of the medium.

10. The printing system according to claim 5, wherein with respect to a print area where printing is to be performed on the medium with the target color ink, after discharging an ink droplet to one surface of the medium, the inkjet head further discharges an ink droplet to another surface of the medium.

11. The printing system according to claim 1, wherein the inkjet head prints at an ink amount such that the target color ink reaches the back surface of the medium.

12. The printing system according to claim 1, wherein the inkjet head prints with a space provided between the back surface of the medium and a carrier of the printing apparatus.

13. The printing system according to claim 1, wherein the constant concentration is an ink amount of the ink reaching the back surface of the medium.

* * * * *